US007806387B2

(12) United States Patent
Wenger et al.

(10) Patent No.: US 7,806,387 B2
(45) Date of Patent: Oct. 5, 2010

(54) CABLE GUIDE

(75) Inventors: Curtis Wenger, Goshen, IN (US); James R. Kraft, New Paris, IN (US)

(73) Assignee: CTB, Inc., Wilmington, DE (US)

( * ) Notice: Subject to any disclaimer, the term of this patent is extended or adjusted under 35 U.S.C. 154(b) by 0 days.

(21) Appl. No.: 12/169,140

(22) Filed: Jul. 8, 2008

(65) Prior Publication Data

US 2009/0014699 A1 Jan. 15, 2009

Related U.S. Application Data

(60) Provisional application No. 60/949,083, filed on Jul. 11, 2007.

(51) Int. Cl.
*B66D 3/04* (2006.01)

(52) U.S. Cl. ..... 254/389; 248/68.1; 248/71; 248/73

(58) Field of Classification Search ..... 254/389; 385/134, 135; 439/527, 610; 248/68.1, 65, 248/71, 73, 49, 67.7; 174/65 R, 50; D8/356; 227/120, 118, 136
See application file for complete search history.

(56) References Cited

U.S. PATENT DOCUMENTS 1,841,353 A * 1/1932 Boggess ..... 411/475
1,855,471 A * 4/1932 Buchanan ..... 248/71
2,680,594 A 6/1954 Jackson
2,901,200 A * 8/1959 Voeks ..... 248/74.5
4,801,061 A * 1/1989 Mangone, Jr. ..... 227/120
4,801,064 A * 1/1989 Mangone, Jr. ..... 227/120
5,393,184 A * 2/1995 Beeuwkes, III ..... 411/469
5,481,888 A * 1/1996 Perry ..... 70/18
5,735,444 A * 4/1998 Wingert ..... 227/120
5,835,652 A 11/1998 Yagi et al.
6,378,813 B1 * 4/2002 Gretz ..... 248/68.1
6,438,311 B1 * 8/2002 Zarnowitz ..... 385/135
6,530,803 B1 * 3/2003 Chen ..... 439/449
6,546,179 B2 4/2003 Petri
6,607,169 B1 * 8/2003 Gershfeld ..... 248/65
6,763,169 B2 * 7/2004 Wentworth et al. ..... 385/134
6,889,944 B2 * 5/2005 Brandzel et al. ..... 248/68.1
6,915,056 B2 * 7/2005 Wentworth et al. ..... 385/134
7,118,318 B2 * 10/2006 Ryals et al. ..... 411/475
D572,572 S * 7/2008 Chang ..... D8/356

OTHER PUBLICATIONS

Preliminary Report on Patentability for related International Application No. PCT/US2008/008389, mailed Jan. 21, 2010.

* cited by examiner

*Primary Examiner*—Emmanuel M Marcelo
(74) *Attorney, Agent, or Firm*—Harness, Dickey

(57) ABSTRACT

A guide adapted to retain a flexible member can include a body defining an arcuate intermediate portion extending between a first end and a second end. The arcuate intermediate portion can define a generally u-shaped cross-section. The intermediate portion can define a throat adapted to slidably capture the flexible member. A mounting aperture can be defined through the first end. At least one finger can be formed on the body. The finger can extend toward the throat and is adapted to retain the flexible member within the throat.

20 Claims, 3 Drawing Sheets

CABLE GUIDE

CROSS-REFERENCE TO RELATED APPLICATIONS

This application claims the benefit of U.S. Provisional Application No. 60/949,083, filed on Jul. 11, 2007. The disclosure of the above application is incorporated herein by reference.

FIELD

This disclosure relates generally to cable guides, and more particularly, to a one-piece cable guide used to slidably capture cables, ropes and the like against a surface.

BACKGROUND

In some applications it may be desirable to locate or fix a cable to an object such as a flat surface. Various locating apparatus such as mounts, pulleys, hooks etc., are available that can provide a user the ability to at least partially fix a cable to a given location. In some instances it may be desirable to allow the cable to slidably communicate along the locating apparatus.

SUMMARY

A guide adapted to retain a flexible member can include a body defining an arcuate intermediate portion extending between a first end and a second end. The arcuate intermediate portion can define a generally u-shaped cross-section. The intermediate portion can define a throat adapted to slidably capture the flexible member. A mounting aperture can be defined through the first end. At least one finger can be formed on the body. The finger can extend toward the throat and is adapted to retain the flexible member within the throat.

According to additional features, the first and second ends can be generally planar. The at least one finger can include a first finger extending from the first end and a second finger extending from the second end. The fingers and the body can be monolithic such that the fingers are pliable relative to the body.

According to other features, the arcuate intermediate portion of the body can define a first and second arched wall portions and a transverse support wall extending between the arched wall portions. A tab can be formed on the body of the cable guide that extends generally into the mounting aperture.

A method for securing a portion of a flexible member in a slidable relationship with a mounting surface can include, locating an intermediate portion of the flexible member. A guide can be advanced over the intermediate portion of the flexible member wherein an arcuate intermediate portion of the guide can locate partially around the flexible member. The guide can be further advanced until planar surfaces defined at opposite ends of the arcuate intermediate portion locate against the mounting surface. A fastener can be advanced through a mounting aperture defined in the guide.

According to additional features, advancing the guide can further comprise, introducing the flexible member within a boundary partially defined by the arcuate intermediate portion. At least one of a pair of fingers formed at the planar surfaces can deflect to accommodate introduction of the flexible member into the arcuate intermediate portion of the guide.

Further areas of applicability of the present disclosure will become apparent from the detailed description provided hereinafter. It should be understood that the detailed description and various examples, while indicating various embodiments of the invention, are intended for purposes of illustration only and are not intended to limit the scope of the following claims.

BRIEF DESCRIPTION OF THE FIGURES

The skilled artisan will understand that the drawings, described below, are for illustration purposes only. The drawings are not intended to limit the scope of the present teachings in any way.

DETAILED DESCRIPTION OF VARIOUS EMBODIMENTS

Aspects of the present teachings may be further understood in light of the following examples, which should not be construed as limiting the scope of the present teachings in any way.

Figure 1:
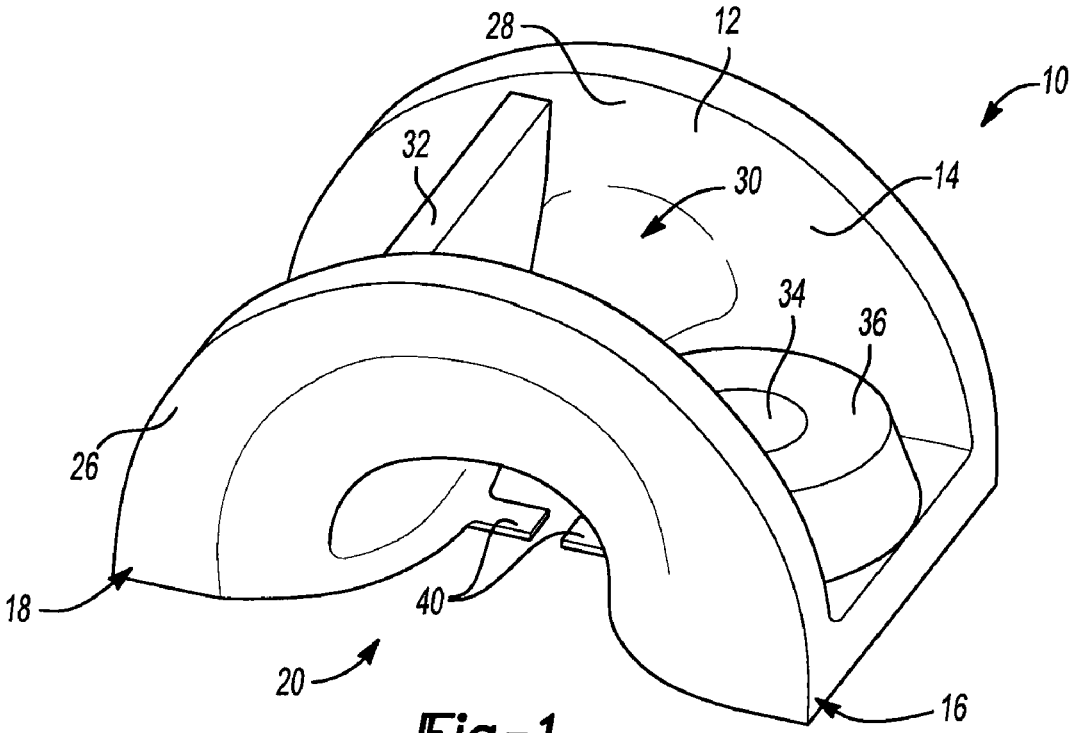
FIG. 1 is a perspective view of a cable guide according to the present teachings.
Figure 5:
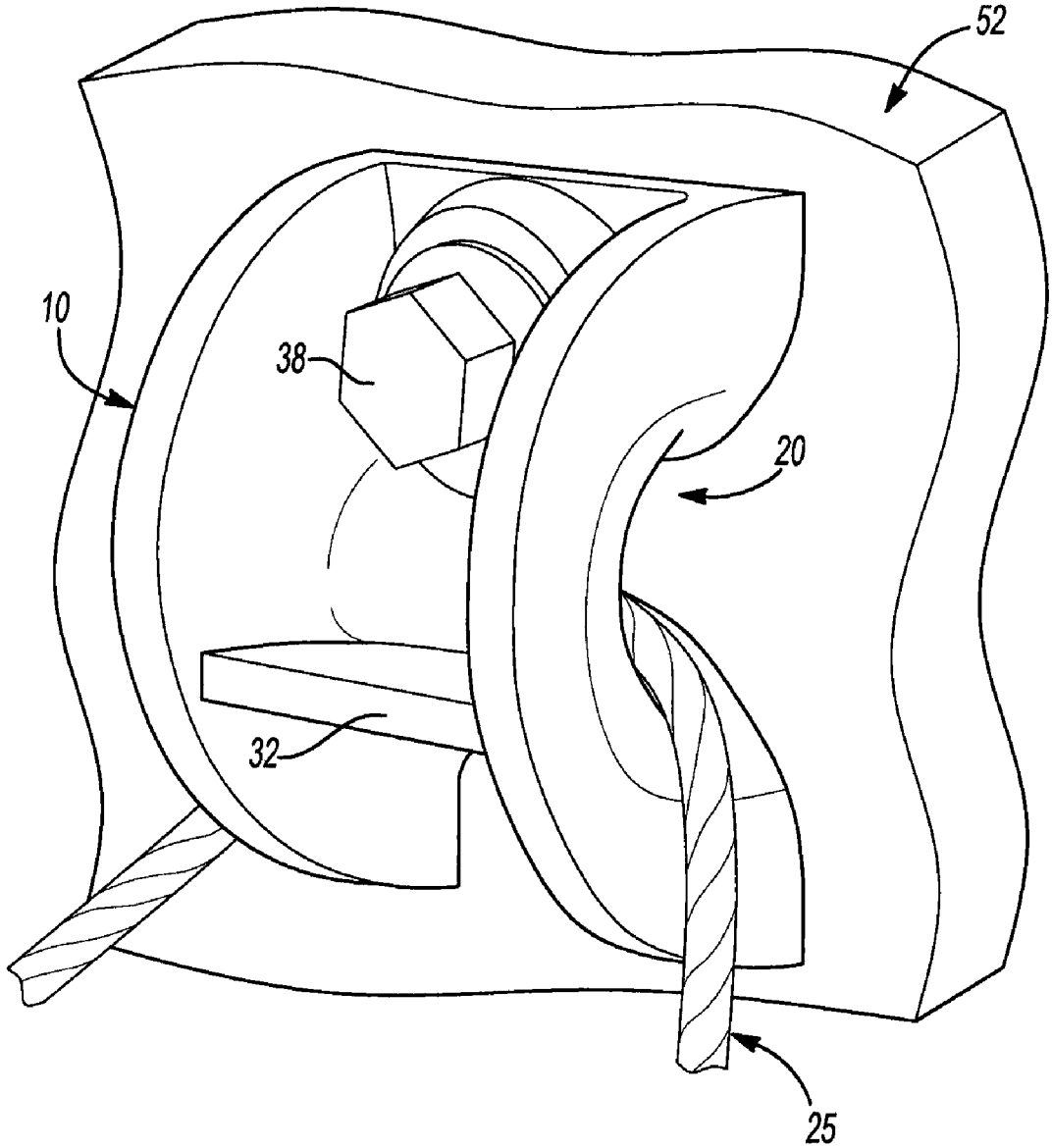
FIG. 5 is a perspective view of the cable guide secured to an exemplary mounting surface with a fastener and having a cable extending through a securing portion in a secured position.

Turning now to the drawings, and initially to FIG. 1, a cable guide is shown and generally identified at reference 10. The cable guide 10 generally includes a body 12 defining an intermediate portion 14 extending between a first end 16 and a second end 18. The arcuate intermediate portion 14 can define a throat 20 for receiving a flexible member 25 (FIG. 5). The arcuate intermediate portion 14 can generally define a first arched wall 26 and a second arched wall 28 that connect through a generally parabolic central portion 30. The first arched wall 26, the second arched wall 28, and the generally parabolic central portion 30 collectively define a u-shaped cross-section of the cable guide 10. A transverse wall 32 can extend between the first and second arched walls 26 and 28, respectively. A mounting aperture 34 can be defined through a raised boss 36 formed on the first end 16. The mounting aperture 34 can receive a fastener 38 (FIG. 5) in a mounted position as will be described. A pair of fingers 40 can be formed on the body 12 at the first and second ends 16 and 18.

Figure 2:
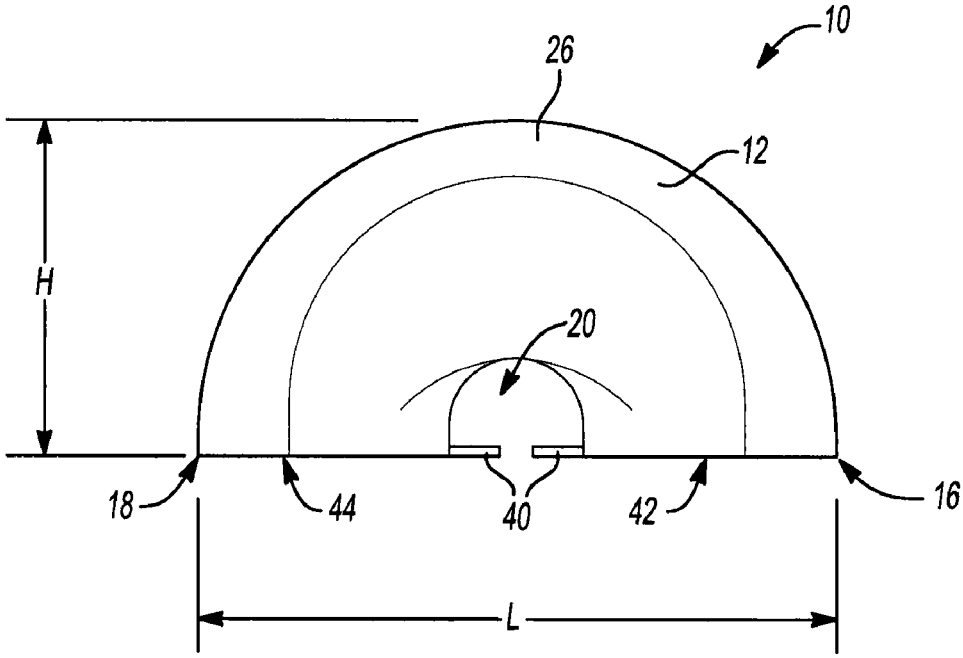
FIG. 2 is a side view of the cable guide of FIG. 1.

Turning now to FIG. 2, the first and second ends 16 and 18 can terminate at generally planar end surfaces 42 and 44, respectively. The transverse wall 32 can be generally perpendicular to the planar end surfaces 42 and 44. In one example, the fingers 40 can extend along the respective planar end surfaces 42 and 44 in a direction toward the throat 20. The fingers 40 at the first and second ends 16 and 18 can facilitate retention of the flexible member 25 (such as a cable, etc.) within the throat 20 if the cable guide 10 deflects or the fastener 38 is not completely tightened. The fingers 40 can be bendable or pliable relative to the body 12. In one example, the fingers 40 may slightly temporarily deflect to accommodate introduction of the flexible member 25 into the throat 20.

Figure 3:
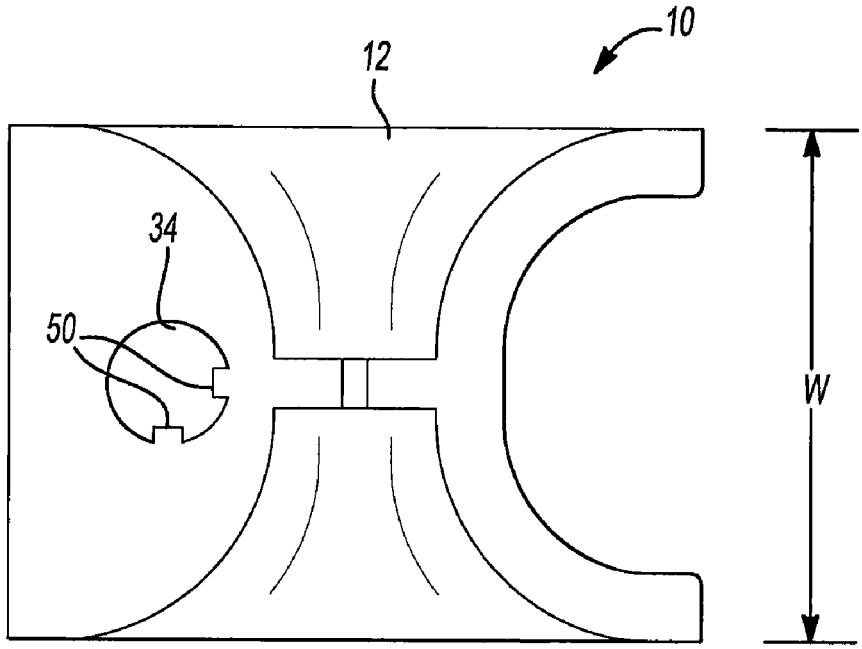
FIG. 3 is a bottom view of the cable guide of FIG. 1.
Figure 4:
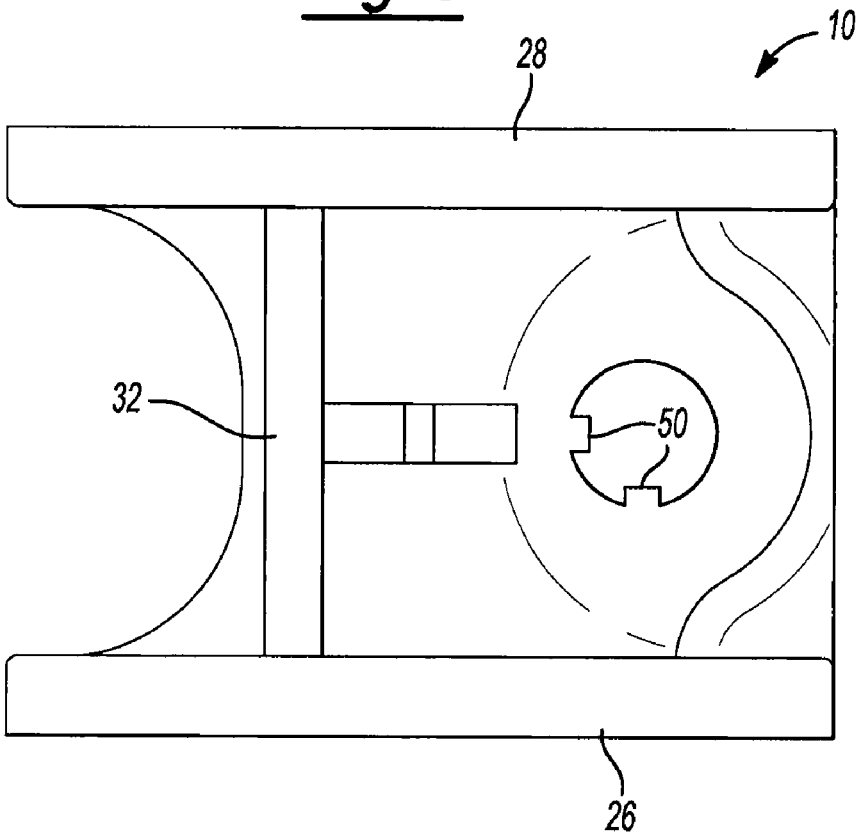
FIG. 4 is top view of the cable guide of FIG. 1.

With reference to FIG. 3, the cable guide 10 can define tabs 50 extending generally into the mounting aperture 34. The tabs 50 can assist in holding the fastener 38 (FIG. 5) in place (i.e. relative to the body 12 in the mounting aperture 34) while mounting the cable guide 10 to a surface.

Exemplary dimensions will now be described. The cable guide 10 can define a length L, a height H and a width W. In one example, the length L can be 1.56 inches, the height H can be 0.84 inch and the width W can be 1.12 inches. It is appreciated that these dimensions are merely exemplary and may vary according to application.

The cable guide 10 can be a unitary component (i.e. monolithic) that can be formed of lightweight, low-friction, and wear-resistant material. In one example, the cable guide 10 can be formed of injection molded plastic such as acetal resin engineering plastic. One exemplary material includes Delrin® manufactured by DuPont.

With reference to FIG. 5, the cable guide 10 is shown mounted to a mounting surface 52 with a flexible member 25 captured within the throat 20. The smooth surface of the arcuate intermediate portion 14 of the cable guide 10 allows the use of cables that would normally fray if wrapped around objects with a smaller contact radius. The large radius contact surface can facilitate cable movement through the throat 20 (and discourage snagging) at any angle less than 90 degrees relative to the mounting surface 52 while holding the flexible member 25 close to the mounting surface 52.

One advantage of the cable guide 10 is that it can be installed over a cable. Explained differently, a cable end need not be threaded through the throat 20 as is required for other devices such as anchors (i.e., pulleys, etc.). In one exemplary method, the cable guide can be located adjacent to a cable with the throat 20 generally aligned toward the cable. The planar end surfaces 42 and 44 can then be advanced toward the mounting surface 52 such that the cable 25 locates through (between) the respective fingers 40. The fastener 38 can then be driven through the mounting aperture 34 to secure the cable guide 10 to the mounting surface 52.

While this disclosure has been described in connection with particular examples thereof, the true scope of the disclosure should not be so limited. Furthermore, other modifications will become apparent to the skilled practitioner upon a study of the drawings, the specification and the following claims.

What is claimed is:

1. A guide adapted to retain a flexible member, the guide comprising:

a body defining an arcuate intermediate portion having a u-shaped cross-section and extending between a first end that terminates at a first planar end surface and a second end that terminates in a second planar end surface, the intermediate portion defining a throat adapted to slidably capture the flexible member;

a mounting aperture defined through the first end; and at least one finger formed on the body and extending from at least one of the first and second planar end surfaces toward the throat, the at least one finger adapted to retain the flexible member within the throat.

2. The guide of claim 1 wherein the first and second ends are coplanar.

3. The guide of claim 2 wherein the at least one finger includes a first finger extending from the first planar end surface and a second finger extending from the second planar end surface.

4. The guide of claim 1 wherein the at least one finger and the body are monolithic and wherein the at least one finger is pliable relative to the body.

5. The guide of claim 1 wherein the arcuate intermediate portion of the body further defines a first and second arched wall portions and a transverse support wall extending between the first and second arched wall portions.

6. The guide of claim 1 wherein the first end defines at least one tab extending into the mounting aperture.

7. The guide of claim 1, further comprising a fastener adapted to extend through the mounting aperture and thereby secure the guide to a surface.

8. A guide adapted to retain a flexible member, the guide comprising:

a body defining a first U-shaped portion laterally offset from a second U-shaped portion, the first and second U-shaped portions cooperating to define a throat adapted to slidably capture the flexible member, wherein first terminal ends of the first and second U-shaped portions terminate at a first planar end of the body and wherein second terminal ends of the first and second U-shaped portions terminate at a second planar end of the body, wherein the first and second planar ends are coplanar;

a transverse wall extending between the first and second U-shaped portions;

a mounting aperture defined through the first planar end; and at least one finger formed on the body and extending toward the throat, the at least one finger capturing the flexible member above the at least one finger and within the throat in an installed position.

9. The guide of claim 8 wherein the at least one finger includes a first finger extending from the first planar end and a second finger extending from the second planar end.

10. The guide of claim 9 wherein the first and second fingers are monolithic and wherein the at least one finger is pliable relative to the body.

11. The guide of claim 8 wherein the first planar end defines at least one tab extending into the mounting aperture.

12. The guide of claim 8, further comprising a fastener that extends through the mounting aperture and thereby secures the guide to a surface.

13. A method for securing a portion of a flexible member in a slidable relationship with a mounting surface, the method comprising:

locating an intermediate portion of the flexible member;

advancing a guide over the intermediate portion of the flexible member wherein an arcuate intermediate portion of the guide locates partially around the flexible member and the flexible member is introduced within a boundary partially defined by the arcuate intermediate portion, wherein at least one of a pair of fingers formed at the planar surfaces deflects to accommodate introduction of the flexible member to a location beyond the at least one of a pair of fingers into the arcuate intermediate portion of the guide;

further advancing the guide until planar surfaces defined at opposite ends of the arcuate intermediate portion locate against the mounting surface; and advancing a fastener through a mounting aperture defined in the guide.

14. A guide adapted to retain a flexible member, the guide comprising:

a body defining an arcuate intermediate portion having a u-shaped cross-section and extending between a first end and a second end, the intermediate portion defining a throat adapted to slidably capture the flexible member;

a mounting aperture defined through the first end;

at least one tab formed on the first end and extending into the mounting aperture; and at least one finger formed on the body and extending toward the throat, the at least one finger adapted to retain the flexible member within the throat.

15. The guide of claim 14 wherein the first and second ends are generally planar.

16. The guide of claim 15 wherein the first and second ends are coplanar.

17. The guide of claim 16 wherein the at least one finger includes a first finger extending from the first end and a second finger extending from the second end.

18. The guide of claim 14 wherein the at least one finger and the body are monolithic and wherein the at least one finger is pliable relative to the body.

19. The guide of claim 14 wherein the arcuate intermediate portion of the body further defines a first and second arched wall portions and a transverse support wall extending between the first and second arched wall portions.

20. The guide of claim 14 wherein the first end defines at least one tab extending into the mounting aperture.

* * * * *